US006320544B1

(12) United States Patent
Korisch et al.

(10) Patent No.: US 6,320,544 B1
(45) Date of Patent: Nov. 20, 2001

(54) METHOD OF PRODUCING DESIRED BEAM WIDTHS FOR ANTENNAS AND ANTENNA ARRAYS IN SINGLE OR DUAL POLARIZATION

(75) Inventors: Ilya A. Korisch, Somerset; Benjamin Rulf, Springfield, both of NJ (US)

(73) Assignee: Lucent Technologies Inc., Murray Hill, NJ (US)

( * ) Notice: Subject to any disclaimer, the term of this patent is extended or adjusted under 35 U.S.C. 154(b) by 0 days.

(21) Appl. No.: 09/544,117

(22) Filed: Apr. 6, 2000

(51) Int. Cl.[7] ..... H01Q 1/38

(52) U.S. Cl. ..... 343/700 MS; 343/767; 343/795; 343/815; 343/834

(58) Field of Search ..... 343/834, 700 MS, 343/767, 795, 797, 815, 817, 818, 833

(56) References Cited

U.S. PATENT DOCUMENTS

| | | | | |
|---|---|---|---|---|
| 4,370,657 | * | 1/1983 | Kaloi | 343/700 MS |
| 4,812,855 | * | 3/1989 | Coe et al. | 343/818 |
| 5,008,681 | * | 4/1991 | Cavallaro et al. | 343/700 MS |
| 5,061,944 | * | 10/1991 | Powers et al. | 343/795 |
| 5,220,335 | * | 6/1993 | Huang | 343/700 MS |
| 6,069,586 | * | 5/2000 | Karlsson et al. | 343/700 MS |

* cited by examiner

*Primary Examiner*—Tho Phan

(57) ABSTRACT

The method of producing antennas and antenna arrays with desired beam widths applies to both single and dual polarization antennas, and controls and modifies the radiation patterns of the antenna's radiating elements by placing appropriately designed parasitic elements in their vicinity.

15 Claims, 5 Drawing Sheets

METHOD OF PRODUCING DESIRED BEAM WIDTHS FOR ANTENNAS AND ANTENNA ARRAYS IN SINGLE OR DUAL POLARIZATION

BACKGROUND OF THE INVENTION

1. Field of the Invention

The present invention relates to antennas; and more particularly, antennas used in wireless communication systems.

2. Description of Related Art

The rapid development of new wireless communication systems has created the need for a variety of new antenna configurations with a broad range of technical requirements. Common to many systems, for both voice and data, is frequency re-use via spatial division into cells, with a base station in every cell center. Cells are often further divided into sectors (typically 3, 4, 5 or 6 sectors per cell), each of which is served by an antenna.

A typical main beam of such a base station antenna must be fan shaped: narrow in the elevation plane to increase the power efficiency, and wide in the azimuth plane to cover one sector.

Some systems utilize polarization diversity to increase the effective signal to interference ratio, which means that the antenna is also required to be sensitive, independently, to two orthogonal polarizations. These could be horizontal and vertical (HP and VP), or slanted (±45).

Many base station antennas are vertical linear arrays of microstrip patch radiators. It is known how to choose the vertical linear array parameters to provide control of the elevation beam width for both polarizations. Controlling the azimuth beam widths in two polarizations, however, is much more difficult, as there are few options available to a designer, especially in the case of a dual polarized antenna. In the case of a dual polarized antenna, the size of the radiating patch, which can provide some degree of control over the beam width, can not be changed at will as the size of the radiating patch is determined by the operating frequency of the antenna. Also, the radiating patch has to be square in order to operate at the same frequency in both polarizations. In many cases the size of the ground plane behind the antenna, which also provides a degree of control over beam width, can not be easily changed because of size limitations or other physical design requirements. Accordingly, a demand exists for a technique which can control the beam width of an antenna even when the size of the radiating element and the ground plane are fixed.

SUMMARY OF THE INVENTION

The inventors have discovered how to control the radiation pattern of a radiating element (e.g., a metallic patch) using parasitic elements. By properly sizing and positioning parasitic elements with respect to the radiating element, a desired beam width for the radiation pattern is obtained. Furthermore, by properly sizing and positioning the parasitic elements, the radiation patterns of different polarization are independently controlled. Accordingly, even under design constraints such as a radiating element of fixed size and a ground plane of fixed size, the method according to the present invention permits control over the beam width of the radiation pattern of a radiating element.

BRIEF DESCRIPTION OF THE DRAWINGS

The present invention will become more fully understood from the detailed description given hereinbelow and the accompanying drawings which are given by way of illustration only, wherein like reference numerals designate corresponding parts in the various drawings, and wherein.

DETAILED DESCRIPTION OF THE PREFERRED EMBODIMENTS

In the design methodology for producing an antenna or antenna array with a desired beam width according to one embodiment of the present invention, an antenna or antenna array is initially designed using well-known techniques. Then, the beam width of the radiation pattern or patterns is controlled using parasitic elements. For purposes of explanation only, the design methodology will be described with respect to the antenna portion 10 of FIG. 1. It will be understood, however, that the design methodology applies to numerous different types of antennas employing any type of radiating element such as printed dipoles and slots. Furthermore, while the present invention and the design methodology included therein will be described with respect to the dual polarization antenna of FIG. 1, it will be understood that the present invention is equally applicable to single polarization antennas.

Figure 1:
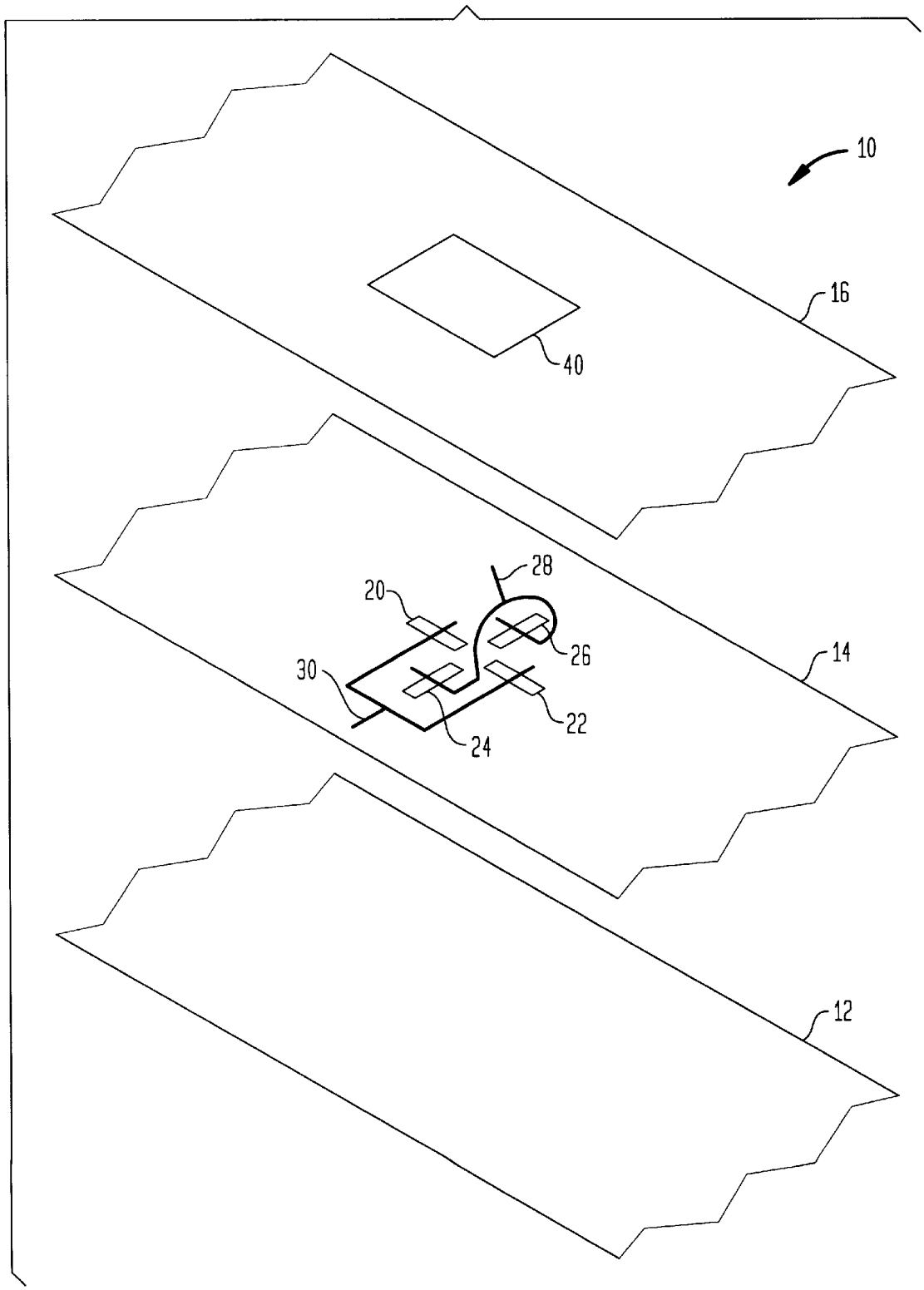
FIG. 1 illustrates an exploded view of a portion of an antenna according to one embodiment of the present invention.

FIG. 1 illustrates an exploded view of a portion of an antenna designed using well-known techniques. The entire, completed antenna is an array of the portion shown in FIG. 1, and will also include parasitic elements (not shown in FIG. 1) as discussed in detail below. As shown, the antenna portion 10 includes first, second and third layers 12, 14 and 16 separated by a dielectric such as air. While not evident from FIG. 1, the first, second and third layers 12, 14 and 16 are spaced closely—about 0.05 to 0.1$\lambda$, where $\lambda$ is the free-space wavelength at the mid-band frequency of the antenna.

The first layer 12 is a metallic (e.g., aluminum) reflector that separates the antenna from the electronics (e.g., radio) behind the antenna. The first layer 12 is commonly referred to as the ground plane, and the size of the first layer 12 is often dictated to the antenna designer by several considerations, such as overall size limitations. In front of the first layer 12 is the second layer 14, which is a printed circuit board. The second layer 14 is metalized on the bottom side, and includes first, second, third and fourth apertures 20, 22, 24, and 26 etched therein. The top side of the second layer 14 includes vertical and horizontal polarization feed networks 28 and 30. A portion of the vertical polarization (VP) feed network 28 crosses the third and fourth apertures 24 and 26, and a portion of the horizontal polarization (HP) feed network 30 crosses the first and second apertures 20 and 22.

The third layer 16 is also a printed circuit board, and is bare except for a metallic patch 40. While not clear from FIG. 1, the metallic patch 40 is positioned over the first-fourth apertures 20–26 on the second layer 14. The metallic patch 40 serves as the radiating element, and generates VP and HP radiation patterns at the same frequency when the VP and HP feed networks 28 and 30 are driven. Because VP and HP radiation patterns are to be generated at the same frequency, the metallic patch 40 is square. Also, as is well-known, the size of the radiating patch 40 is dictated by the operating frequency of the antenna.

While not shown in FIG. 1 for the purposes of clarity, the antenna further includes a plastic cover over the third layer 16 to protect the antenna and the electronics from the environment. This cover is commonly referred to in the art as the radome.

As discussed above, an antenna such as shown in FIG. 1 does not necessarily generate radiation patterns having desired beam widths. The inventors discovered that parasitic elements affect the radiation pattern of the radiating element, and that the parasitic elements could be used to control the radiation pattern and obtain a desired beam width for a radiation pattern. Next, the procedure for applying parasitic elements to control the beam widths of the radiation pattern will be described.

Figure 2:
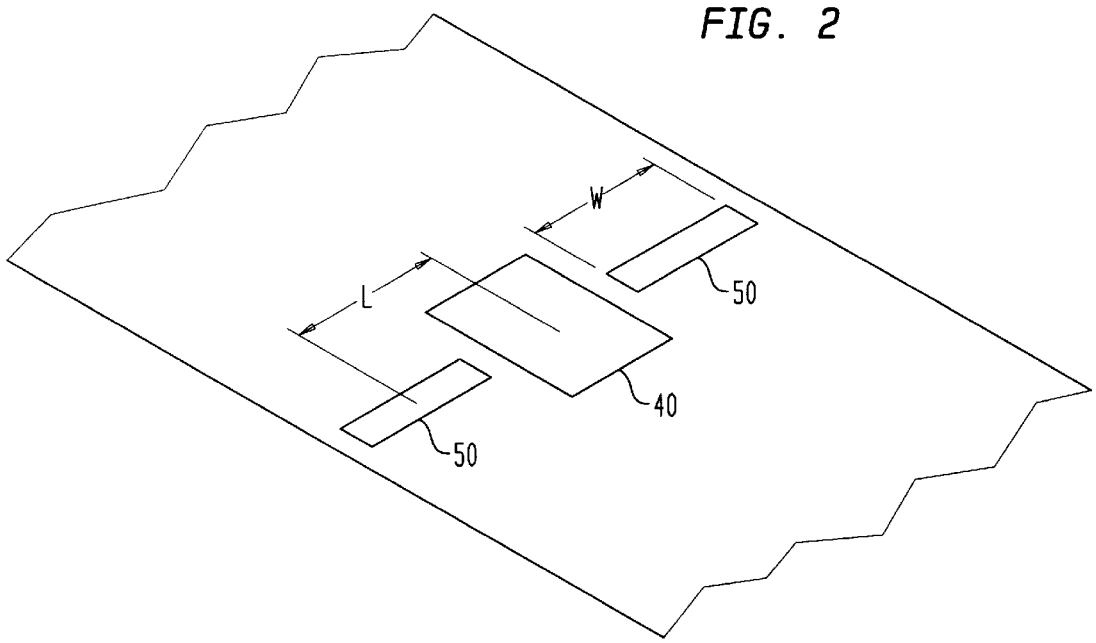
FIG. 2 illustrates the formation of parasitic elements with respect to a radiating element in generating data on the affect parasitic elements have on the horizontal polarization radiation pattern of the radiating element.

As shown in FIG. 2, metallic patches 50, serving as parasitic elements in that they are not driven by any feed network, are formed on opposite sides of the radiating patch 40. The longitudinal centerline of the parasitic patches 50 in the transverse direction of the antenna are a distance L (measured in units of wavelength λ) from the centerline of the radiating patch 40. As will be apparent from the following, the initial value of L is a matter of design choice. Furthermore, the parasitic patches 50 each have a width W related to the width of the radiating patch 40, but lengths substantially less than the length of the radiating patch 40. As a result, the parasitic patches 50 will affect the HP radiation pattern produced by the radiating patch 40, but not the VP radiation pattern.

After forming the parasitic patches 50 as described above, the radiating patch 40 is driven to by a test signal, and the beam width of the HP radiation pattern is measured. The measured beam width and associated values of the distance L and the width W are recorded.

Next, the structure of FIG. 2 is repeatedly formed, each structure having a different distance L. Again the set of distances L used is a matter of design choice. After each structure is formed, the beam width of the HP radiation pattern is recorded in association with the values of the distance L and the width W.

Then, the width W of the parasitic patches 50 is changed, and the procedure of (1) forming the structure of FIG. 2 for the set of distances L, (2) measuring the beam width of the HP radiation pattern for each structure and (3) recording the beam width values in association with the values of the distance L and width W is repeated. This procedure is repeated for a set of widths W; the set of width W being a matter of design choice.

Figure 4:
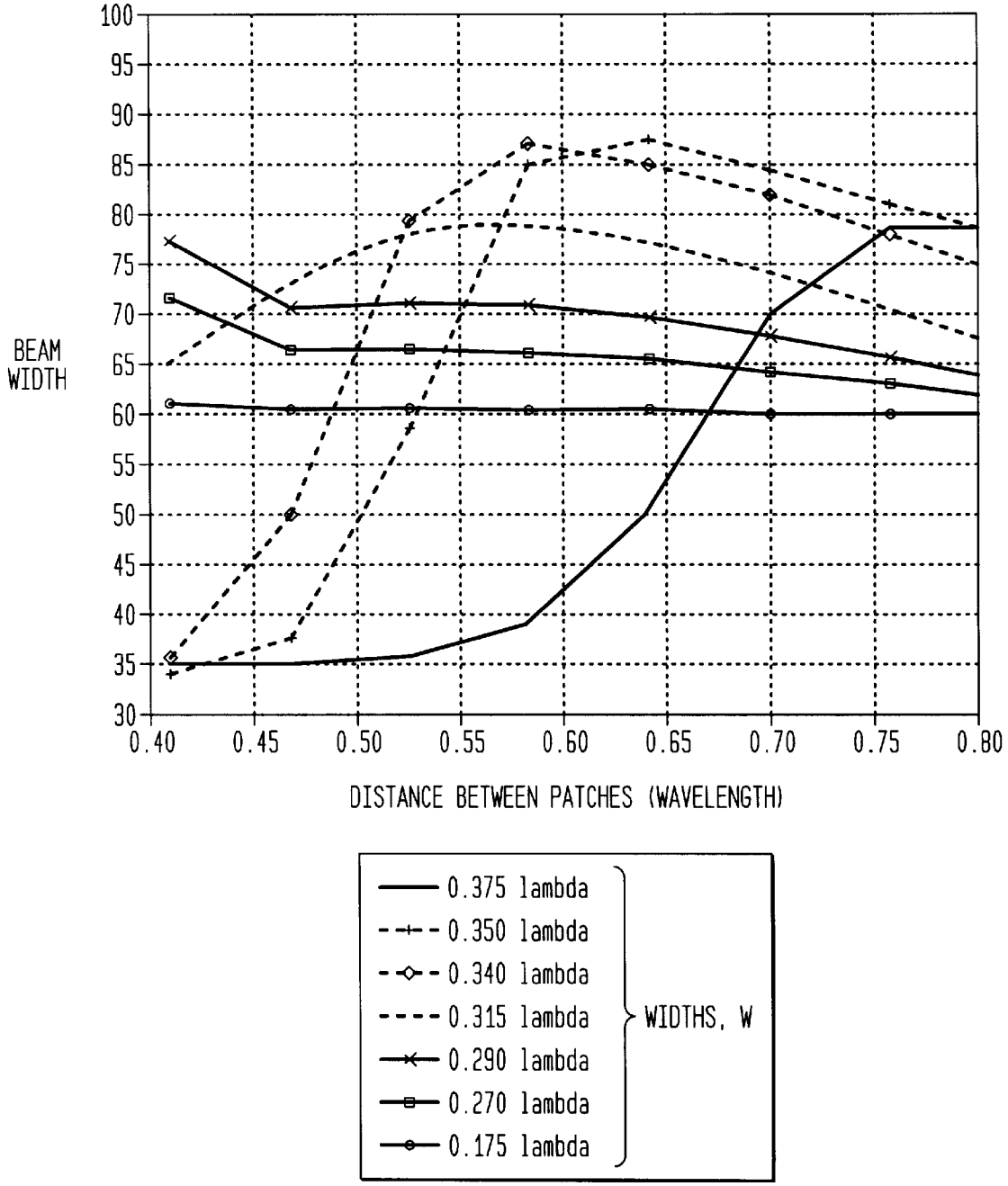
FIG. 4 illustrates horizontal polarization radiation pattern data generated according to the design methodology of the present invention.

FIG. 4 illustrates the HP radiation pattern data generated according to this procedure for an antenna portion having the structure shown in FIGS. 1 and 2, wherein the radiating patch 40 had the dimensions of 0.35λ×0.35λ. More specifically, FIG. 4 illustrates a graph of the beam width versus the distance L for parasitic patches 50 of different widths W.

Figure 3:
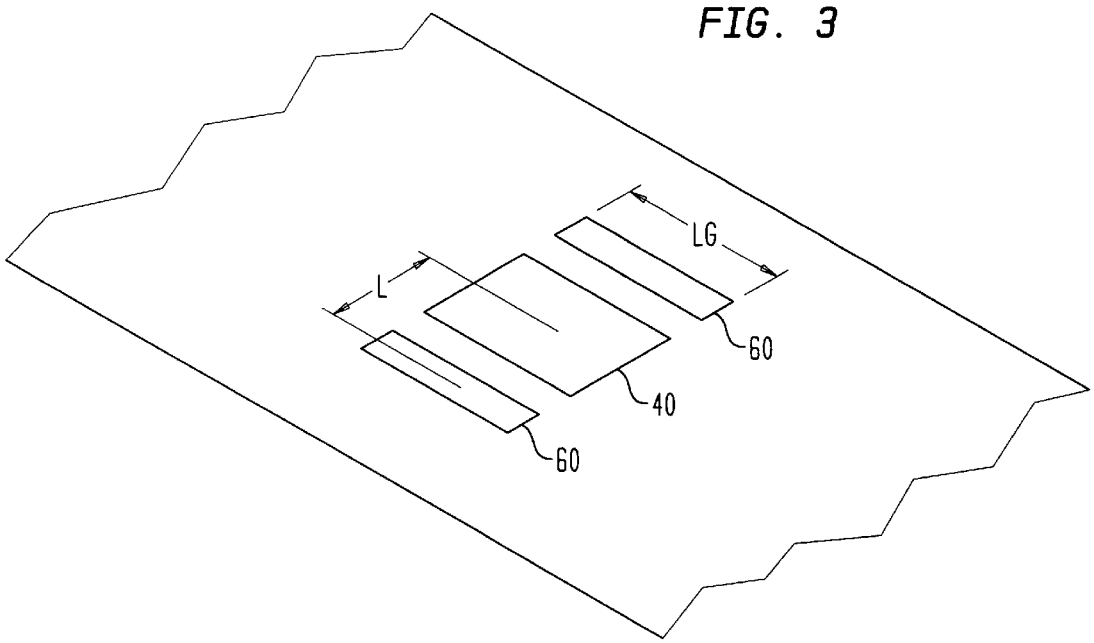
FIG. 3 illustrates the formation of parasitic elements with respect to the radiating element in generating data on the affect parasitic elements have on the vertical polarization radiation pattern of the radiating element.

The procedure for generating the data indicating the affect parasitic elements having on the HP radiation pattern of a radiation element is then repeated for the VP radiation pattern of the radiation element. However, as shown in FIG. 3, the parasitic patches 60 for affecting the VP radiation pattern have different dimensions than the parasitic patches 50 affecting the HP radiation pattern. As shown in FIG. 3, the width of the parasitic patches 60 is substantially less than the width of the radiating patch 40 so as not to affect the HP radiation pattern. Accordingly, in repeating the data generation procedure for the VP radiation pattern, the length LG of the parasitic patches 60 is varied in the same manner that the width W of the parasitic patches 50 was varied.

Figure 5:
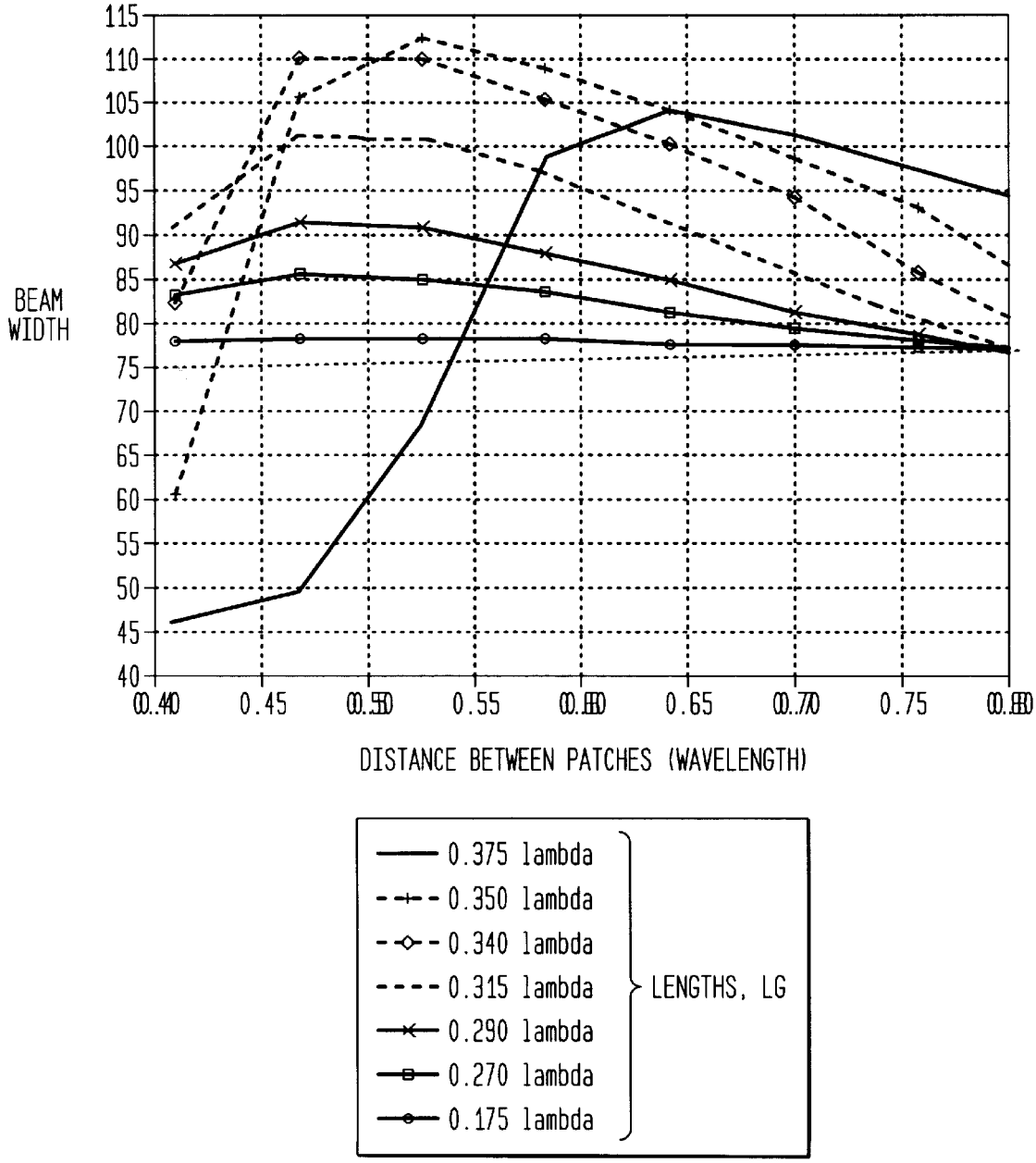
FIG. 5 illustrates vertical polarization radiation pattern data generated according to the design methodology of the present invention.

FIG. 5 illustrates the VP radiation pattern data generated for an antenna portion having the structure shown in FIG. 3, wherein the radiating patch 40 had the dimensions of 0.35λ×0.35λ. More specifically, FIG. 5 illustrates a graph of the beam width versus the distance L for parasitic patches 60 of different lengths LG.

Instead of physically forming the different structures discussed above to generate HP and VP radiation pattern data, this data can be generated through computer simulation.

Using the HP and VP radiation pattern data, such as shown in FIGS. 4 and 5, the antenna designer may be able to choose a single pair of parasitic elements that will produce desired beam widths in the HP and VP radiation patterns (i.e., a pair of parasitic elements having dimensions W×LG and a distance L from the radiating element to produce the desired beam widths).

However, it may happen that in order to create a desired beam width, a common distance L for affecting both the HP and VP radiation pattern beam widths can not be found. In this case, two pairs of parasitic elements will have to be used. One pair of parasitic elements will be chosen from FIG. 4 to affect the HP radiation pattern beam width, and only the HP radiation pattern beam width. Accordingly, this pair of parasitic elements has a length LG substantially less than the radiating element so as not to affect the VP radiation pattern. Another pair of parasitic elements will be chosen from FIG. 5 to affect the VP radiation pattern beam width, and only the VP radiation pattern beam width. Accordingly, this pair of parasitic elements has a width W substantially less than the radiating element so as not to affect the HP radiation pattern.

It will be recognized, however, that the pair of parasitic elements affecting the HP radiation pattern and the pair of parasitic elements affecting the VP radiation pattern will have to be offset in the longitudinal direction of the antenna from one another to prevent one set of parasitic elements from shielding, and therefore, interfering with the other set of parasitic elements. Furthermore, this offsetting of the parasitic elements may slightly change the affect on beam width and require a small change in the distance L or width W (or length LG) of the offset parasitic elements. This fine tuning of the offset parasitic elements can be performed in the same manner that the HP and VP radiation pattern data were generated.

Figure 6:
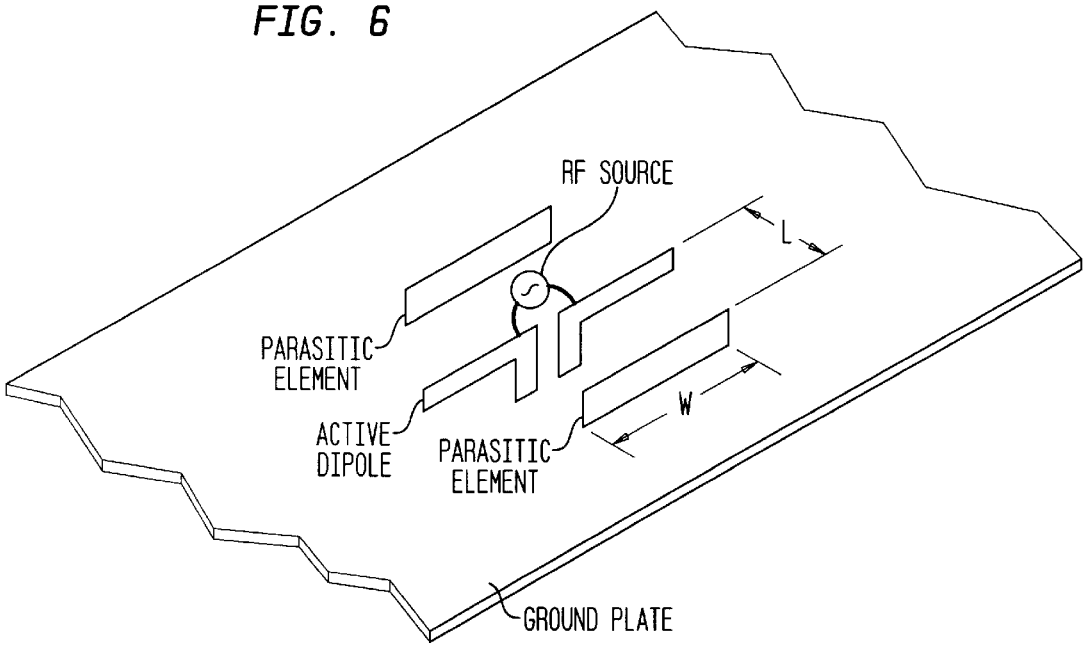
FIG. 6 illustrates the printed dipole embodiment of the present invention.
Figure 7:
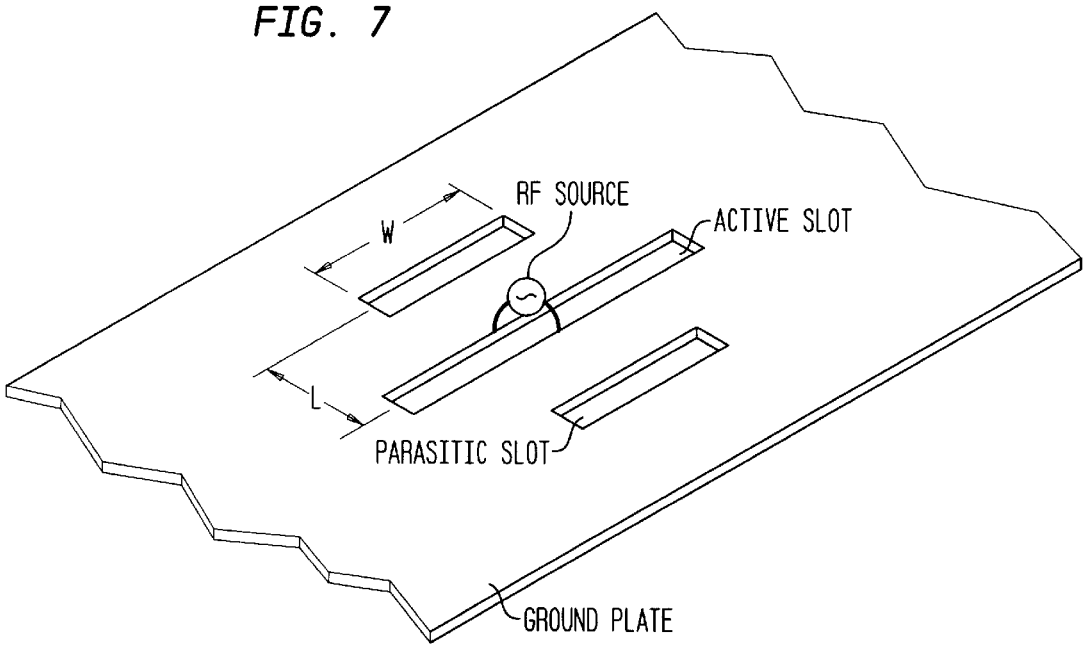
FIG. 7 illustrates the etched slot embodiment of the present invention.

While the design methodology of the present invention was described with respect to an aperture coupled patch antenna, it should be understood that the present invention is applicable to many other types of antennas and radiating elements such as a printed dipole shown in FIG. 6 and an etched slot shown in FIG. 7.

Furthermore, while the design methodology of the present invention was described with respect to a dual polarized antenna, the design methodology is equally applicable to a single polarization antenna.

As demonstrated above, the radiation pattern of a radiating element (e.g., a metallic patch) can be controlled using parasitic elements. By properly sizing and positioning parasitic elements with respect to the radiating element, a desired beam width for the radiation pattern is obtained. Furthermore, by properly sizing the parasitic elements, the radiation patterns of different polarization are independently controlled.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A method of producing an antenna or antenna array with a desired beam width, comprising:

forming a radiating element having a radiation pattern; and controlling the radiation pattern to have a desired beam width by forming parasitic elements in association with the radiating element.

2. The method of claim 1, wherein said controlling step comprises:

forming parasitic elements of a certain size and at a certain distance from the radiating element to obtain the radiation pattern with the desired beam width.

3. The method of claim 1, wherein the radiating element is one of a metallic patch, printed dipole, and etched slot.

4. The method of claim 1, further comprising:

generating data indicative of an effect parasitic elements have on the beam width of the radiation pattern; and wherein the controlling step controls the radiation pattern to have the desired beam width by forming parasitic elements based on the generated data.

5. A method of producing a dual polarization antenna or antenna array with desired beam widths for each polarization, comprising:

forming a radiating element having a first and second radiation pattern of a first and second polarization, respectively;

controlling the first and second radiation patterns to have first and second desired beam widths, respectively, by forming parasitic elements in association with the radiating element.

6. The method of claim 5, wherein the controlling step comprises:

independently controlling the first radiation pattern to have the first desired beam width by forming first parasitic elements in association with the radiating element; and independently controlling the second radiation pattern to have the second desired beam width by forming the second parasitic elements in association with the radiation element.

7. The method of claim 6, wherein the first controlling step includes, forming parasitic elements of a first certain size and at a first certain distance from the radiating element;

the second controlling step includes, forming parasitic elements of a second certain size and a second certain distance from the radiating element.

8. The method of claim 6, further comprising:

generating data indicative of an effect parasitic elements have on the beam width of the radiation pattern; and wherein the independently controlling the first radiation pattern step controls the first radiation pattern to have the first desired beam width by forming parasitic elements based on the generated data; and the independently controlling the second radiation pattern step controls the second radiation pattern to have the second desired beam width by forming parasitic elements based on the generated data.

9. The method of claim 5, wherein the radiating element is one of a metallic patch, printed dipole and etched slot.

10. An antenna or antenna array, comprising:

a radiating element formed on a substrate; and first parasitic elements formed on said substrate adjacent to opposite sides of said radiating element, said first parasitic elements separated from said radiating element and dimensioned to cause said radiating element to produce a radiation pattern of a first polarization with a first desired beam width.

11. The antenna of claim 10, wherein said parasitic elements are separated from said radiating element and dimensioned to cause said radiating element to produce said radiation pattern of said first polarization with said first beamwidth and to produce a radiation pattern of a second polarization with a second beam width.

12. The antenna of claim 11, further comprising:

second parasitic elements formed on said substrate adjacent to opposite sides of said radiating element, said second parasitic elements separated from said radiating element and dimensioned to cause said radiating element to produce a radiation pattern of a second polarization with a second desired beam width.

13. The antenna of claim 12, wherein said first polarization is horizontal polarization and said second polarization is vertical polarization.

14. The antenna of claim 12, wherein said second parasitic elements are separated from said first parasitic elements such that said second parasitic elements do not shield said first parasitic elements.

15. The antenna of claim 12, wherein said first desired beam width equals said second desired beam width.

* * * * *